US012385716B2

(12) United States Patent
Axelsson

(10) Patent No.: US 12,385,716 B2
(45) Date of Patent: Aug. 12, 2025

(54) GAS-POWERED GUN

(71) Applicant: FX Airguns AB, Mariestad (SE)

(72) Inventor: Johan Axelsson, Mariestad (SE)

(73) Assignee: FX RnD AB, Mariestad (SE)

( * ) Notice: Subject to any disclaimer, the term of this patent is extended or adjusted under 35 U.S.C. 154(b) by 0 days.

(21) Appl. No.: 18/797,620

(22) Filed: Aug. 8, 2024

(65) Prior Publication Data

US 2025/0237468 A1 Jul. 24, 2025

(30) Foreign Application Priority Data

Jan. 23, 2024 (EP) ..... 24153528

(51) Int. Cl.
*F41B 11/00* (2013.01)
*F41B 11/50* (2013.01)
*F41B 11/723* (2013.01)

(52) U.S. Cl.
CPC ..... *F41B 11/723* (2013.01); *F41B 11/50* (2013.01)

(58) Field of Classification Search
CPC ..... F41B 11/52; F41B 11/62; F41B 11/60; F41B 11/723; F41B 11/50; F41B 11/73
USPC ..... 124/50, 75, 74
See application file for complete search history.

(56) References Cited

U.S. PATENT DOCUMENTS 2,301,653 A 11/1942 Wells
5,337,726 A * 8/1994 Wood ..... F41B 11/68 124/75
5,476,378 A * 12/1995 Zagoroff ..... F23D 14/36 431/352
6,708,685 B2 * 3/2004 Masse ..... F41B 11/724 124/75
7,686,005 B2 * 3/2010 Adams ..... F41B 11/71 89/7
8,006,602 B2 8/2011 Myrick
8,336,532 B2 * 12/2012 Masse ..... F41B 11/71 124/75
10,801,804 B2 * 10/2020 Sandgren ..... F41B 11/50
2009/0032003 A1 * 2/2009 Masse ..... F41B 11/721 124/73

FOREIGN PATENT DOCUMENTS

GB 2427671 A 1/2007

OTHER PUBLICATIONS

Extended European Search Report, issued Jul. 1, 2024, in corresponding European Application No. 24153528.5-1015, 5 pages.

* cited by examiner

*Primary Examiner* — Michael D David
(74) *Attorney, Agent, or Firm* — Panitch Schwarze Belisario & Nadel LLP

(57) ABSTRACT

A gas-powered gun comprising an inner barrel (31), a compartment (40) for compressed gas formed coaxially around the inner barrel (31), a pressure regulator (42) connected between the compartment (40) and a pressure chamber (10), so as to ensure a controlled pressure in the pressure chamber (10), and a valve (15) arranged to release compressed gas from the pressure chamber (10) to thereby discharge a projectile (13) provided in said inner barrel (31). The gas-powered gun further comprises a plenum chamber (70) in fluid connection with the pressure chamber (10), the plenum chamber being formed in a detachable module (7) arranged below the barrel during normal use.

5 Claims, 6 Drawing Sheets

GAS-POWERED GUN

CROSS-REFERENCE TO RELATED APPLICATION

This Application claims priority from application Ser. No. 24/153,528.5 filed on Jan. 23, 2024 in European Patent Office. The entire contents of these applications are incorporated herein by reference in their entirety.

FIELD OF THE INVENTION

The present invention relates to a gas-powered gun comprising a pressure chamber holding compressed gas and a valve arranged to release compressed gas from the pressure chamber to thereby discharge a projectile provided in a barrel.

BACKGROUND ART

Gas powered guns of the above-mentioned kind are well known in the art, and the compressed gas may be e.g. air (air guns).

In most guns of this kind, a source of compressed gas, e.g. a gas canister, is detachably attached to the gun, e.g. below the barrel or behind the handle. This gives the gun a characteristic appearance, clearly signalling that this is a gas-powered gun.

It is also known to arrange the source of compressed gas in an annular compartment around the barrel of the gun. Such a design is shown in document GB 2 427 671. An esthetical advantage with such an "internal" source of compressed gas is that the gun may be perceived as a "real" gun. However, a drawback the gun disclosed in GB 2 427 671 is that it has very limited firing power.

In principle, the power of a gas-power gun is determined by the volume of the pressure chamber, from which gas is released to fire the gun. For this reason, is known to provide a gas-powered gun with an extension of the pressure chamber, a so-called "plenum".

Various add-on plenum devices are available to provide an increased firing power. Such conventional plenum devices are typically arranged between a detachable gas bottle and the pressure chamber. In order to ensure a controlled, pre-defined pressure in the plenum and pressure chamber, a regulator is typically arranged between the gas canister and plenum.

SUMMARY OF THE INVENTION

In view of the above, it is an object of the present invention to provide a gas-powered gun with an "internal" source of compressed gas resembling a "real" gun and also having a satisfactory firing power.

This and other objects are achieved by a gas-powered gun comprising an inner barrel, a compartment formed coaxially around the inner barrel, the compartment configured to be filled with compressed gas, a pressure regulator connected between the compartment and a pressure chamber, so as to ensure a controlled pressure in the pressure chamber, and a valve arranged to release compressed gas from the pressure chamber to thereby discharge a projectile provided in the inner barrel. The gas-powered gun further comprises a plenum chamber in fluid connection with the pressure chamber. The plenum chamber is formed in a detachable module arranged below the barrel during normal use, which detachable module has an interface configured to form an air-tight fluid connection with the pressure chamber when the module is secured to the gun.

This design provides a unique combination of an internal (*invisible*) source of compressed gas, and an increased firing power. While the detachable plenum module does have an impact on the visual appearance of the gun, its placement below the barrel during normal use makes it possible to design the module so that it resembles a magazine for bullets.

By making the plenum module detachable, with an interface for air-tight connection, different modules with different plenum chamber volume and different appearance may be provided.

It is noted that the gun disclosed in GB 2 427 671 is technically incompatible with a detachable plenum module according to the present invention.

In some embodiments, the detachable module includes a body having at least one cylindrical bore forming the plenum chamber, which cylindrical bores are in fluid connection with each other. Forming the plenum chamber as one or several cylindrical bores is an efficient way to form a volume capable of withstanding high pressure.

Each bore may have a closed inner end and an open outer end (from which the bore has been drilled), with the open outer end being sealed with a plug and optionally sealed with an appropriate sealing element such as an O-ring.

The module may further comprise a channel connecting the closed inner end of a primary bore with an outside of the body, with an opening of the channel being provided with a sealing element to form the air-tight interface. For example, the primary bore may be drilled with a first drill-bit, having a first, larger diameter, while the channel is drilled with a second drill-bit, having a second, smaller diameter.

BRIEF DESCRIPTION OF THE DRAWINGS

The present invention will be described in more detail with reference to the appended drawings, showing currently preferred embodiments of the invention.

DETAILED DESCRIPTION OF CURRENTLY PREFERRED EMBODIMENTS

Figure 1:
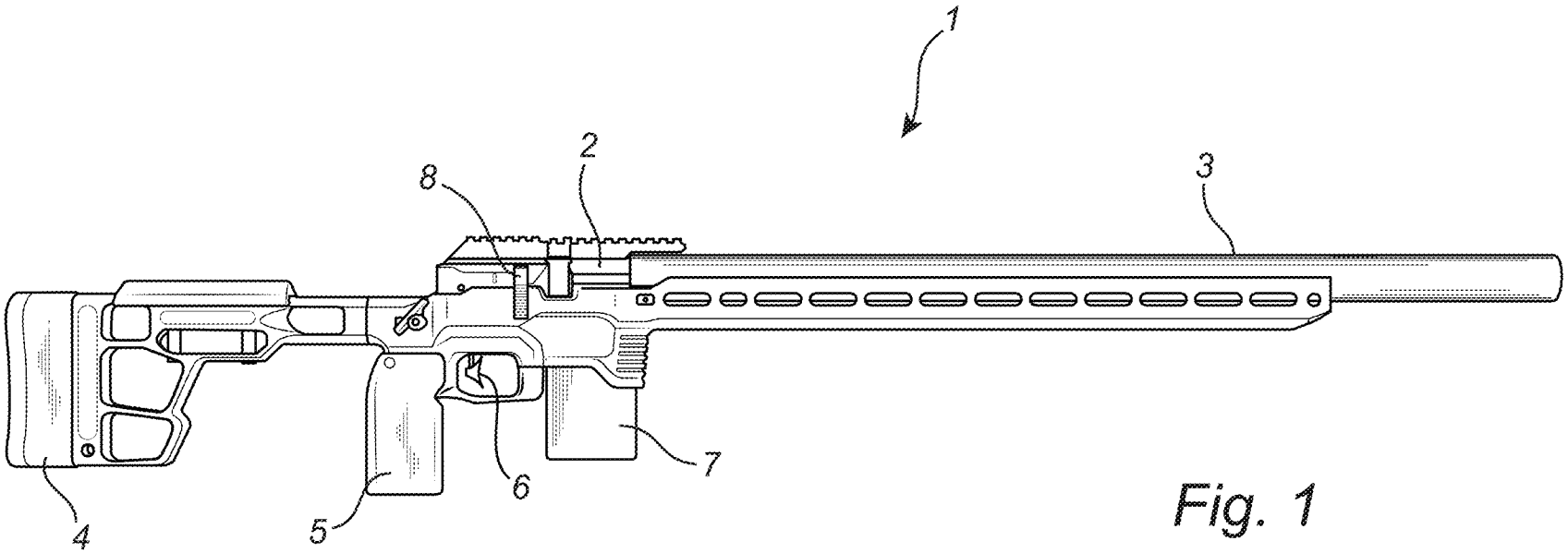
FIG. 1 shows an air gun according to an embodiment of the present invention.

The gas-powered gun 1 in FIG. 1 generally includes a body 2, a barrel 3, a stock 4 and a grip 5 with a trigger 6. According to the present invention, the gun 1 is also provided with a detachable module 7 housing a plenum chamber as will be further discussed below. The gun also has a lever 8 which can be operated when loading the gun.

Figure 2:
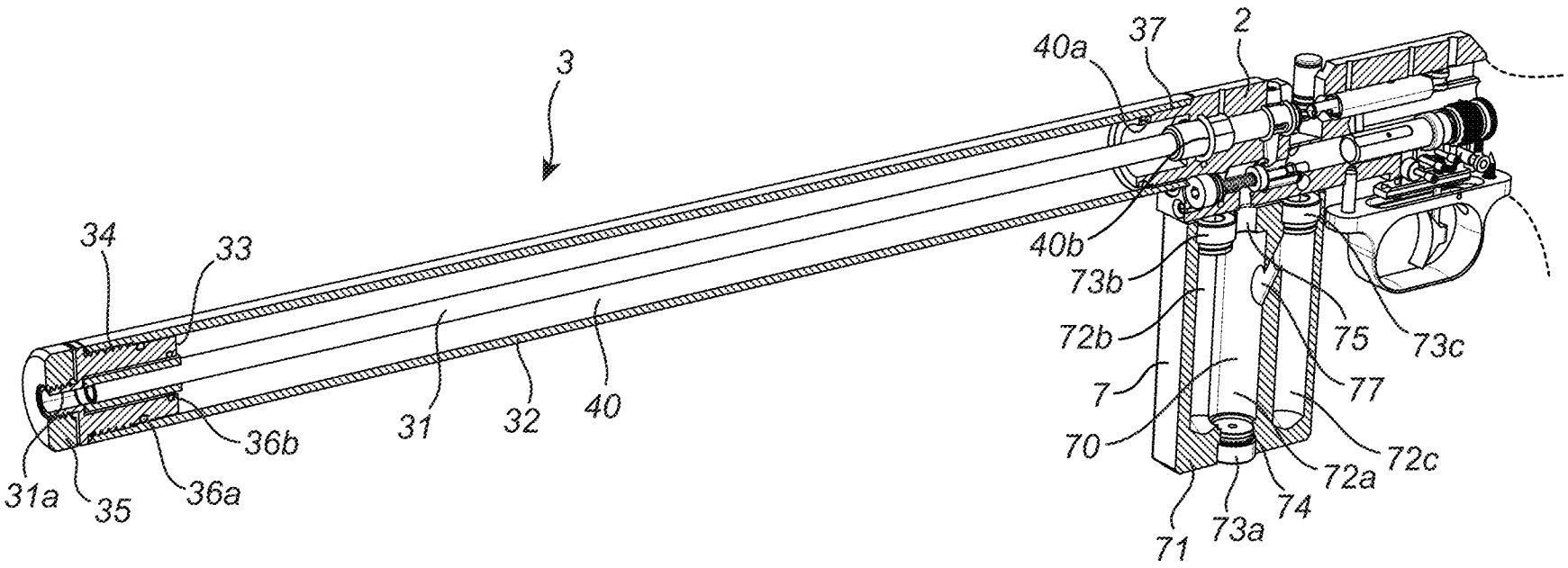
FIG. 2 shows parts of the gun in FIG. 1 partly broken away.

Turning to FIG. 2, the body 2 and barrel 3 of the gun have been broken away to better illustrate the design of the gun 1. As shown in FIG. 2, the barrel 3 comprises an inner barrel 31 and a coaxial outer sleeve 32.

In the front end of the gun 1, an annular plug 33 is inserted between the inner barrel 31 and the outer sleeve 32. The plug 33 is held in place in the outer sleeve 32 by a threaded connection 34. The inner barrel 31 extends through a central opening of the annular plug 33, so as to be movable in the axial direction with respect to the plug 33 and hence with respect to the outer sleeve 32. This is advantageous as the inner barrel 31 may be formed in a different material than the sleeve 32, thereby exhibiting different heat expansion. In the illustrated example, an outer cap 35 is attached (e.g. threaded) to the outer portion 31*a* of the inner barrel 31.

A first sealing element such as an O-ring 36*a* provides an air-tight seal between the plug 33 and the outer sleeve 32 and a second sealing element, such as an O-ring 36*b* provides an air-tight seal between the plug 33 and the inner barrel 31.

In the rear end, the outer sleeve 32 is fitted to the body 2 of the gun 1, with a threaded connection 37, and air-tight sealed against the body with a third sealing element, such as an O-ring 38*a*. The inner barrel 31 extends into the body 2, and a fourth sealing element, such as an O-ring 38*b*, provides an air-tight seal against the body 2.

The annular space between the inner barrel 31 and the outer sleeve 32 thereby forms a pressure tight compartment 40 which can be filled with compressed gas 50, such as air, to be used for firing the gun 1. The compartment 40 is preferably provided with a suitable inlet (not shown) for filling the compartment 40.

A channel 41 (see FIG. 4C) is formed in the body 2 to connect the compartment 40 with a pressure regulator 42. The outlet of the regulator 42 is in fluid connection with a pressure chamber 10 via another channel 43. The pressure regulator 42 ensures a precisely controlled (regulated) pressure in the pressure chamber 10. The pressure chamber has an opening 44 facing towards the detachable module 7.

The detachable module 7 houses a plenum chamber 70 formed in a body 71. The plenum chamber 70 may comprise one or several sub-chambers. In the illustrated example, the plenum chamber 70 comprises three cylindrical bores 72*a-c*, which have been drilled into the body 71. Each sub-chamber 72*a-c* has a closed inner end, and an open outer end sealed by a threaded plug 73*a-c* and an O-ring 74.

Figure 3:
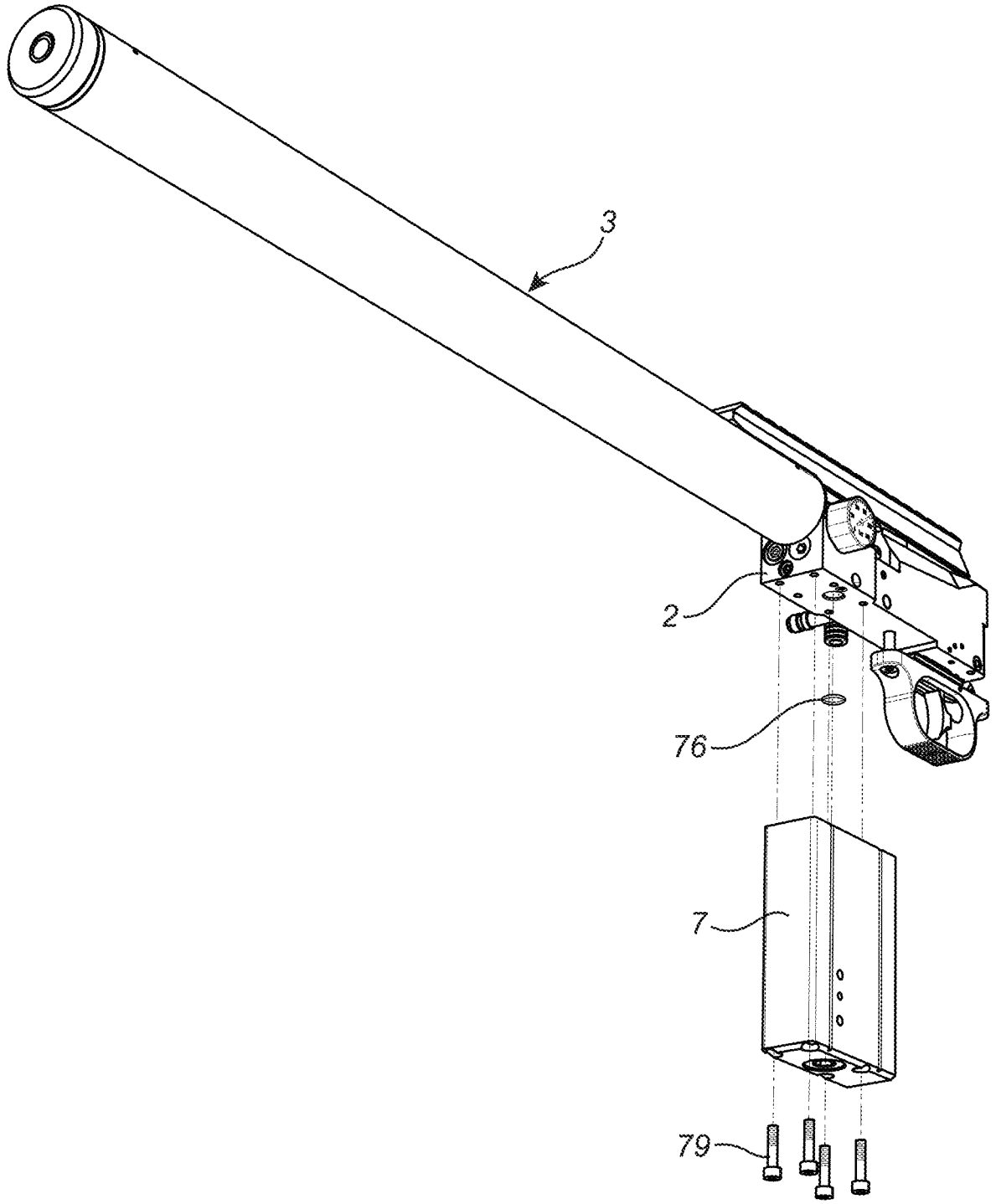
FIG. 3 shows parts of the gun in FIG. 1 in a partly exploded view.

As shown in FIG. 3, the module 7 is attached to the body 2 of the gun 1 by means of four screws 79. Other attachment means, including snap-on mountings are also possible.

A primary bore 72*a* has its closed inner end facing the gun 1. A channel 75 is formed to connect the primary bore 72*a* with the outside of the body 71. For example, the primary bore 72*a* may be drilled from the outside with a large diameter drill-bit. Then, the channel 75 may be drilled in a subsequent step from the opposite direction (or from the same direction with a long drill).

The opening of the channel 75 is sealed by sealing element, such as an O-ring 76 (see FIG. 3), to provide an air-tight seal between the plenum chamber 70 and the opening 44 of the pressure chamber 10 when the module 7 is screwed tight to the body 2 of the gun 1. When the module 7 is secured to the body 2 of the gun 1, the pressure chamber 10 is in fluid connection with the larger plenum chamber 70. The plenum chamber 70 thus forms an extension of the pressure chamber 10, and the pressure in the plenum is also regulated by the regulator 42.

Bores 72*b* and 72*c* have here been drilled from the opposite direction with respect to primary bore 72*a*, such that their outer openings, where the plugs 73*b*, 73*c* are fitted, face towards the gun 1. Bore 72*b* has been drilled at such a c-c distance with respect to the primary bore 72*a* that the two bores 72*a*, 72*b* are in fluid connection. Bore 72*c* is here formed separate from the primary bore 72*a*, and is connected to the primary bore 72*a* by a channel 77.

Figure 4A:
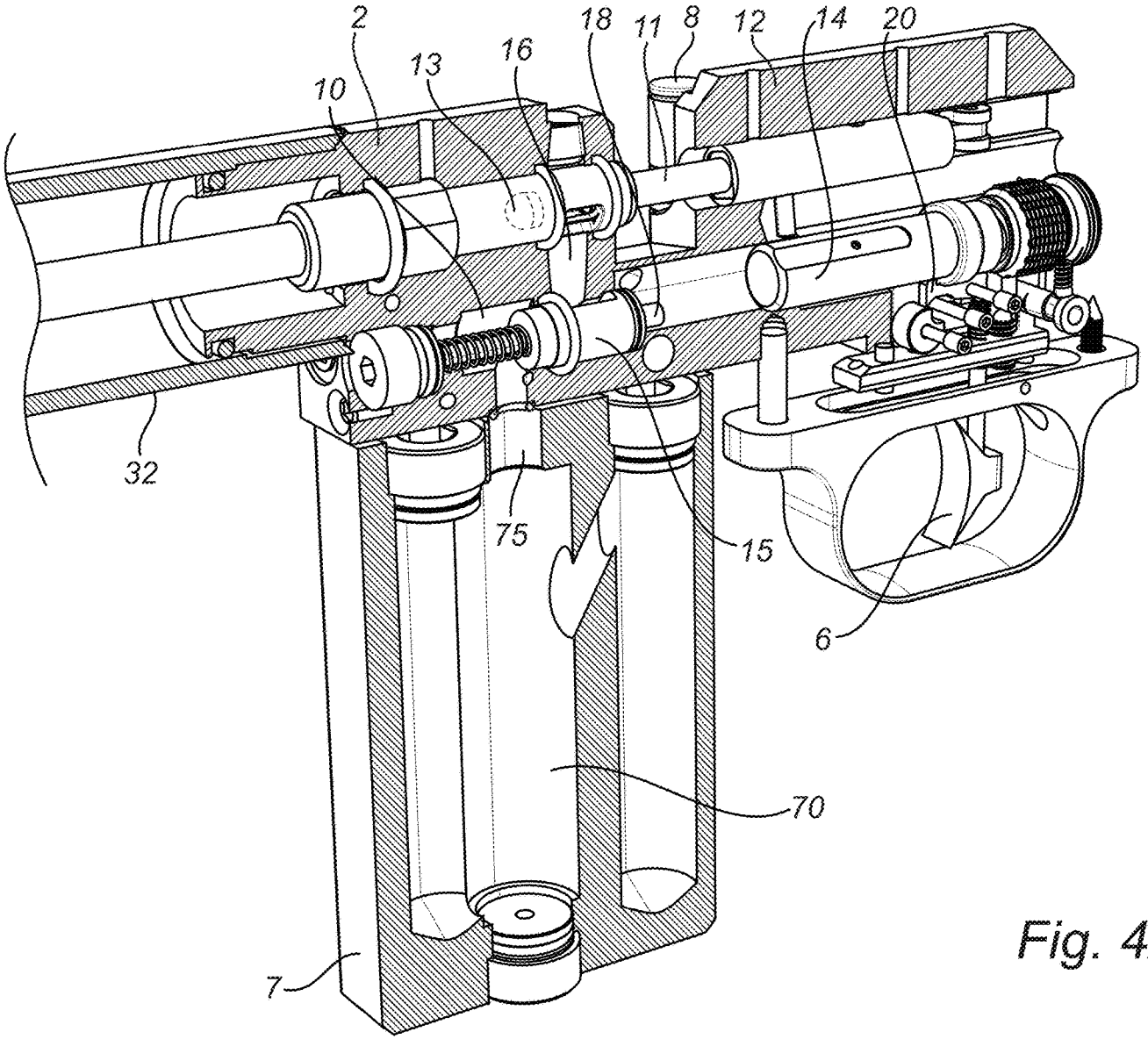
FIG. 4A shows the gun in FIG. 1 in a loaded, ready-to-fire state.
Figure 4B:
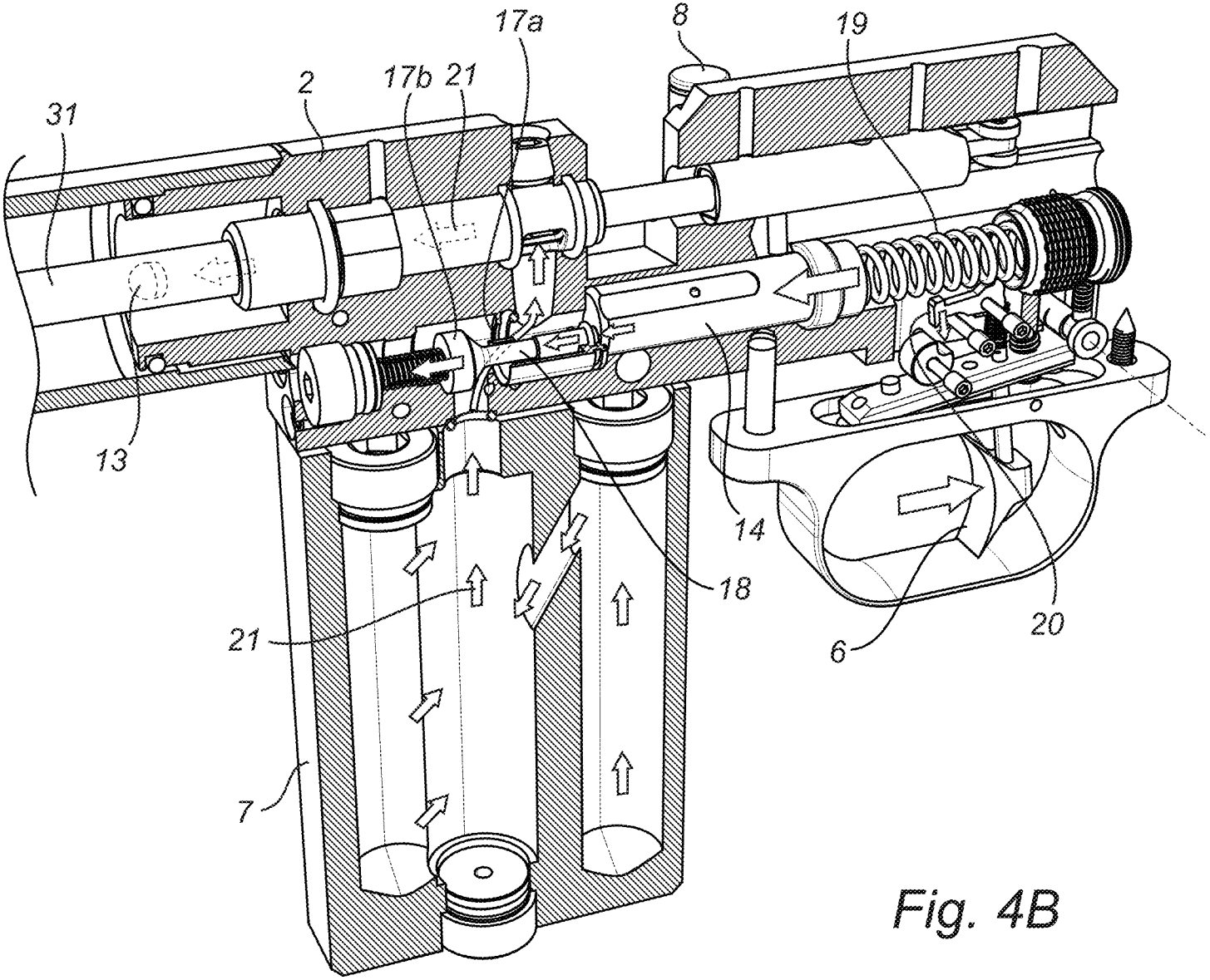
FIG. 4B shows the gun in a state of firing.
Figure 4C:
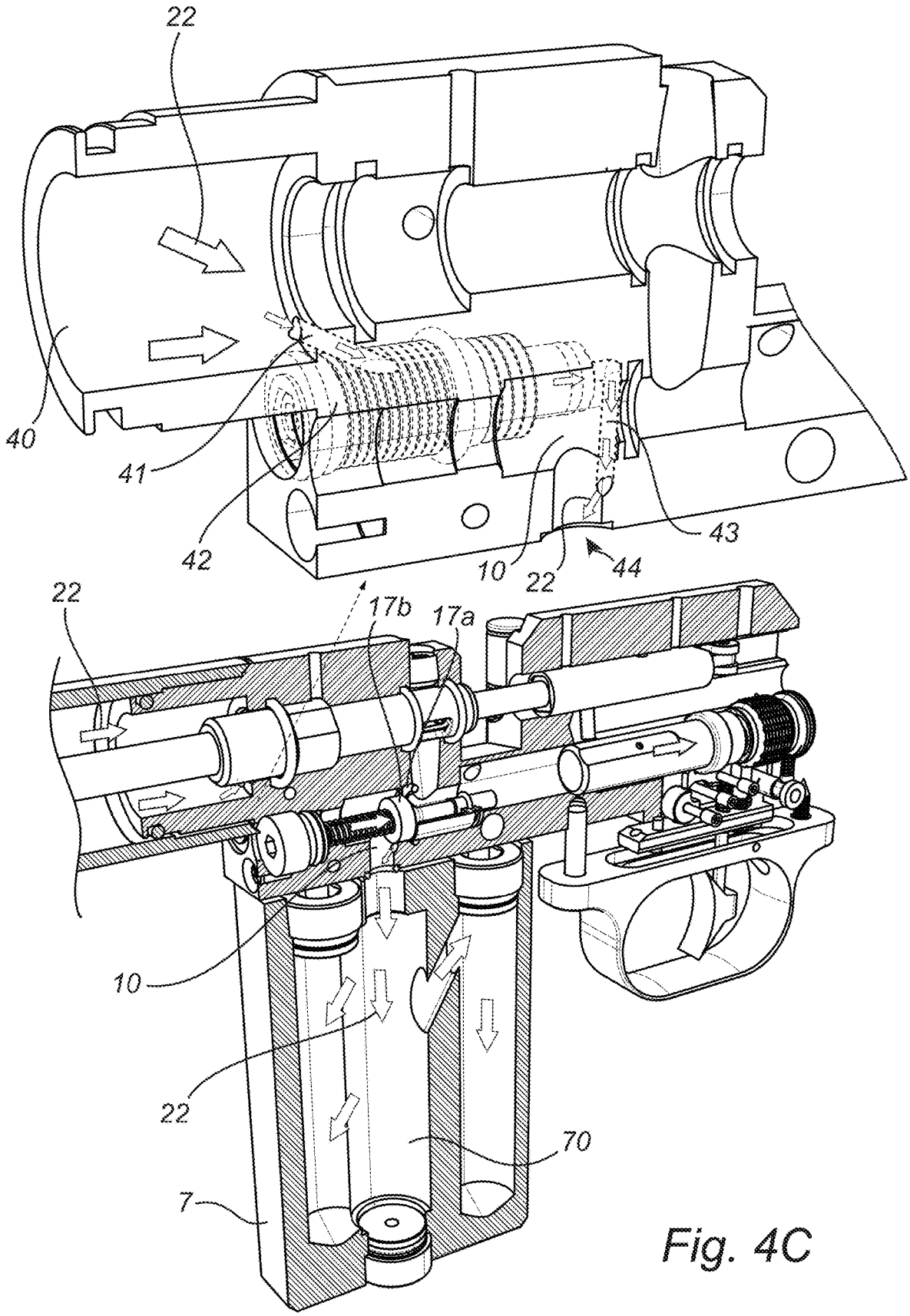
FIG. 4C shows the gun after firing.

Turning to FIG. 4A-4C, the operation of the gun 1 will be discussed in more detail.

As shown in FIG. 4A, the gun 1 comprises a feeder pin 11 slidably arranged in a housing 12 (part of the body 2) behind the barrel 3. The gun 1 further comprises a spring-loaded hammer 14, arranged to operate an open-close valve 15, which connects the pressure chamber 10 to a space 16 immediately behind and below the bullet. As shown more clearly in FIG. 4B, the valve 15 includes a valve-seat 17*a* forming an opening of the pressure chamber 10, and a valve-head 17*b* arranged inside the pressure chamber and being pressed against the valve-seat 16 to seal the chamber 10. The valve-head 17*a* has a hammer cooperating portion 18 extending rearwards through the opening, so that it can be engaged by the hammer 14.

The feeder pin 11 and hammer 14 are mechanically connected to the lever 8. In order to load the gun 1, the lever 8 is pulled out and back, thereby sliding the feeder pin 11 back to allow a bullet (projectile) 13 to be inserted in a space in front of the feeder pin 11. In the same motion, the spring-loaded hammer 14 is brought back against the force of the biasing spring 19, and held in place by a catch 20, mechanically connected to the trigger 6. The lever 8 is then pushed forward, sliding the feeder pin 11 forward, and pushing the bullet 13 into a firing position inside the inner barrel 31, as shown in FIG. 4A. The hammer 18 stays in spring loaded position, and the gun is in a loaded position (FIG. 4A).

At the moment of firing (FIG. 4B), the trigger 6 releases the catch 20 and the hammer 14 is pushed into contact with the portion 18, thereby opening the valve 15. Compressed gas 21 is now allowed to enter the space 16 from the pressure chamber 10 and plenum chamber 70, thereby discharging the bullet 13. The force transferred to the bullet will be determined by the regulated pressure and the combined volume of the pressure chamber 10 and plenum 70.

As shown in FIG. 4C, immediately after discharging the bullet 13, compressed air 22 will flow from the compartment 40 via the regulator 42 into the pressure chamber 10 and plenum chamber 70. The increasing pressure will push the valve head 17*b* against the valve seat, again sealing the pressure chamber from the space 16. The valve head 17*b* may also be spring loaded to ensure fast sealing. As soon as the pressure in the pressure chamber 10 and plenum 70 has returned to the regulated pressure, the gun is ready to be loaded and fired.

The person skilled in the art realizes that the present invention by no means is limited to the preferred embodiments described above. On the contrary, many modifications and variations are possible within the scope of the appended claims. For example, the details of the firing mechanism are purely exemplary, and other options may be available. Further, the front end sealing of the compartment 40 may be designed in many ways, as long as the sealing is able to withstand the pressure in the compartment 40.

The invention claimed is:

1. A gas-powered gun for discharge of projectiles, comprising:

an inner barrel;

a compartment formed coaxially around said inner barrel, said compartment configured to be filled with compressed gas;

a pressure regulator connected between the compartment and a pressure chamber, so as to ensure a controlled pressure in the pressure chamber; and a valve arranged to release compressed gas from the pressure chamber to thereby discharge a projectile provided in said inner barrel;

wherein the gas-powered gun further comprises a plenum chamber in fluid connection with the pressure chamber, said plenum chamber being formed in a detachable module arranged below the barrel during normal use, said detachable module having an interface configured to form an air-tight fluid connection with the pressure chamber when the module is secured to the gun.

2. The gas-powered gun according to claim 1, wherein said detachable module includes a body having at least one cylindrical bore forming said plenum chamber, said cylindrical bores being in fluid connection with each other.

3. The gas-powered gun according to claim 2, wherein each bore has a closed inner end and an open outer end, said open outer end being sealed with a plug.

4. The gas-powered gun according to claim 2, wherein the module further comprises a channel connecting the closed inner end of a primary bore with an outside of the body, an opening of said channel being provided with a sealing element to form the air-tight interface.

5. The gas-powered gun according to claim 3, wherein the module further comprises a channel connecting the closed inner end of a primary bore with an outside of the body, an opening of said channel being provided with a sealing element to form the air-tight interface.

* * * * *